US010344465B2

(12) United States Patent
McIntyre

(10) Patent No.: US 10,344,465 B2
(45) Date of Patent: Jul. 9, 2019

(54) CONCEALED WALL-MOUNTED FOLDING URINAL

(71) Applicant: ADVANCED GLOBAL INNOVATIONS PTY. LTD., Bundall (AU)

(72) Inventor: Mitchell Rex McIntyre, Mermaid Beach (AU)

(73) Assignee: Advanced Global Innovations Pty. Ltd. (AU)

( * ) Notice: Subject to any disclaimer, the term of this patent is extended or adjusted under 35 U.S.C. 154(b) by 193 days.

(21) Appl. No.: 14/888,615

(22) PCT Filed: May 5, 2014

(86) PCT No.: PCT/AU2014/000494
§ 371 (c)(1),
(2) Date: Nov. 2, 2015

(87) PCT Pub. No.: WO2014/179827
PCT Pub. Date: Nov. 13, 2014

(65) Prior Publication Data

US 2016/0060856 A1 Mar. 3, 2016

(30) Foreign Application Priority Data

May 6, 2013 (AU) ..... 2013901592

(51) Int. Cl.
*E03D 13/00* (2006.01)
*E03D 11/12* (2006.01)

(52) U.S. Cl.
CPC ..... *E03D 11/12* (2013.01); *E03D 13/00* (2013.01)

(58) Field of Classification Search
CPC ..... E03D 11/12; E03D 13/00; E03D 13/005; E03D 5/105

(Continued)

(56) References Cited

U.S. PATENT DOCUMENTS 202,193 A 4/1878 Reid
2,076,950 A * 4/1937 Koch ..... E03D 11/12 4/111.1

(Continued)

FOREIGN PATENT DOCUMENTS

CN 2040125 * 6/1989 ..... E03D 11/00
CN 2040125 U 6/1989

(Continued)

OTHER PUBLICATIONS

International Search Report, PCT Application PCT/AU2014/000494, dated Jun. 3, 2014.

(Continued)

*Primary Examiner* — David P Angwin
*Assistant Examiner* — Nicholas A Ros
(74) *Attorney, Agent, or Firm* — Barnes & Thornburg LLP

(57) ABSTRACT

A concealed wall-mounted folding urinal has a main body adapted to be mounted on an internal wall of a bathroom or lavatory. A tray is pivotally attached to the main body for movement between a first, standby, position and a second, ready for use, position in which the tray is ready to receive urine from a male person standing before the urinal. A sensor detects the presence of a person within a predetermined distance of the urinal, whereupon an actuating mechanism pivots the tray from the first position to the second position. When the sensor detects the absence of a person within a predetermined distance of the urinal, the actuating mechanism pivots the tray from the second position to the first position, whereupon the urinal is flushed with water.

16 Claims, 13 Drawing Sheets

(58) Field of Classification Search
USPC ..... 4/301, 307, 311–312, 662–664, 644
See application file for complete search history.

(56) References Cited

U.S. PATENT DOCUMENTS

| | | | | | |
|---|---|---|---|---|---|
| 2,101,523 | A * | 12/1937 | Willis | A47K 1/02 | 4/664 |
| 4,488,321 | A * | 12/1984 | Brunton | E03D 13/00 | 4/300.3 |
| 4,799,272 | A * | 1/1989 | Horng | E03D 11/12 | 4/312 |
| 6,286,153 | B1 | 9/2001 | Keller | | |
| 7,805,869 | B1 * | 10/2010 | Pascarelli | G09F 23/06 | 4/301 |
| 7,865,869 | B2 * | 1/2011 | Kurz | G06F 9/4443 | 717/104 |
| 8,904,570 | B2 * | 12/2014 | Brooks | A47K 11/12 | 4/144.1 |
| 2010/0269248 | A1 * | 10/2010 | Nowak | E03D 3/12 | 4/313 |
| 2012/0079650 | A1 * | 4/2012 | Metcalf | E03D 11/12 | 4/311 |
| 2012/0117719 | A1 | 5/2012 | Brooks | | |

FOREIGN PATENT DOCUMENTS

| | | | | |
|---|---|---|---|---|
| CN | 2546534 | | 4/2003 | |
| CN | 1730851 | | 2/2006 | |
| CN | 201224756 | Y | 6/2009 | |
| CN | 201933592 | U | 8/2011 | |
| CN | 101956419 | | 2/2012 | |
| CN | 203905140 | U | 10/2014 | |
| DE | 19902933 | | 8/2000 | |
| DE | 202004002285 | U1 | 7/2004 | |
| DE | 202005003305 | U1 | 8/2005 | |
| GB | 2436838 | | 10/2007 | |
| JP | 11-346960 | | 12/1999 | |
| JP | 2002-256609 | | 9/2002 | |
| JP | 2013092029 | | 5/2013 | |
| KR | 10-0815020 | | 3/2008 | |
| KR | 10-2011-0046114 | | 5/2011 | |
| KR | 1020120036039 | | 4/2012 | |
| KR | 1020150011061 | | 1/2015 | |
| WO | WO2004097126 | * | 11/2004 | E03D 13/00 |

OTHER PUBLICATIONS

JL Mott Iron Works, Demarest's Swing Urinal and Patent Folding Urinal, http://digitalcollections.nypl.org/items/510d47db-bce0-a3d9-e040-e00a18064a99.

Mister Miser, Mister Miser: The Amazing Folding Urinal, http://www.treehugger.com/bathroom-design/mister-miser-the-amazing-folding-urinal.html.

English Abstract of Chinese Patent CN201933592 (U)—Aug. 17, 2011 for Wall Embedded Type Multifunctional Toilet Bowl.

English Abstract of German Patent DE19902933 (A1)—Aug. 17, 2000 for Wall-Mounted Pivoted Urinal.

English Abstract of German Patent DE202005003305 (U1)—Jul. 21, 2005 for Wall-Mounted Swing Toilet Bowl/Urinal.

JL Mott, What is it? A urinal, http://www.vintageplumbing.com/thejlmottironworks.html.

* cited by examiner

CONCEALED WALL-MOUNTED FOLDING URINAL

CROSS REFERENCE TO RELATED APPLICATIONS

This application is a U.S. nationalization under 35 U.S.C. § 371 of International Application No. PCT/AU2014/000494, filed May 5, 2014, which claims priority to Australian Patent Application No. 2013901592, filed May 6, 2013. The disclosures set forth in the referenced applications are incorporated herein by reference in their entireties.

This invention relates to installations for receiving human waste, and in particular relates to urinals.

Urinals, for use by male persons, are well known. Normally used in public toilets, they take a number of different forms. Some urinals of ceramic, or more likely, metal material, are able to accommodate a number of persons standing side-by-side. Other, usually older-style, urinals are similar, but have divisions to provide some privacy. Many modern public toilets have individual wall-mounted urinals. Some of these wall-mounted urinals have privacy screens between adjacent units, and some installations have one or more urinals located in a lower position on a wall, to cater for young male children.

It has not been standard practice to install urinals in bathrooms of dwellings, hotels or motels. In Europe, many such bathrooms have both a pedestal toilet and a bidet, but no urinal. It is considered that to have a urinal in a domestic or hotel/motel bathroom would be more than acceptable to females, who would not have to worry about male members of the family, or male visitors, urinating on the toilet seat, or leaving the seat up. However, there would normally be insufficient space for a urinal to be installed, in addition to other bathroom fixtures.

Some folding urinals have been described in the prior art. The website of vintageplumbing.com describes and shows an "all china folding personal urinal" produced by The J. L Mott Iron Works, which was featured in an 1895 catalogue. The urinal, bearing the patent date 1876, has "an all china body, all china fold open door that becomes the receptacle when open, and amazing faucet that is activated by the lever that holds the door". The Mister Miser (Trade Mark) folding urinal is featured at the websites of treehugger.com and hometone.com. This urinal appears to be mounted partially within a wall cavity, and has a manually-operated cover which is able to be moved from a vertical, closed position to an angled position for use.

CN201933592 discloses a wall embedded type multifunctional toilet bowl having a fixed type frame body embedded in a wall and a toilet base with a urinal. The base is able to be moved from a vertical, closed, position to a horizontal position for use. DE19902933 shows a wall-mounted pivoted urinal which may be moved from a position flush against a wall into lower horizontal positions by pivot bars hinged to a basin. When flush against the wall, the basin is covered by a wan-mounted hood. DE202005003305 discloses a wall-mounted swing toilet bowl/urinal which is on a swing axis to be moved manually from a vertical position against a wall into a horizontal position for use.

None of the prior art devices provides an optimum folding urinal for domestic and other uses. By way of example, the Mister Miser urinal has nothing to prevent urine from splashing out of the sides of the urinal when it is in an "in use" position, and the urinal of DE202005003305 protrudes into the room in which it is located, even in the closed position. It is accordingly an object of this invention to provide an improved folding urinal.

The invention provides a folding urinal including a main body and a tray connected to said main body, said tray being adapted to move between a first position in which it abuts said main body, in which first position said folding urinal is in standby mode, and a second position in which it is at an angle to said main body portion, in which second position said tray is in a ready for use mode and adapted to receive urine from a user of said folding urinal, characterised in that actuating means mounted on said body and connected to said tray is adapted to move said tray between said first position and said second position.

An embodiment of the invention will be described in detail hereinafter, with reference to the accompanying drawings, in which:—

Figure 1:
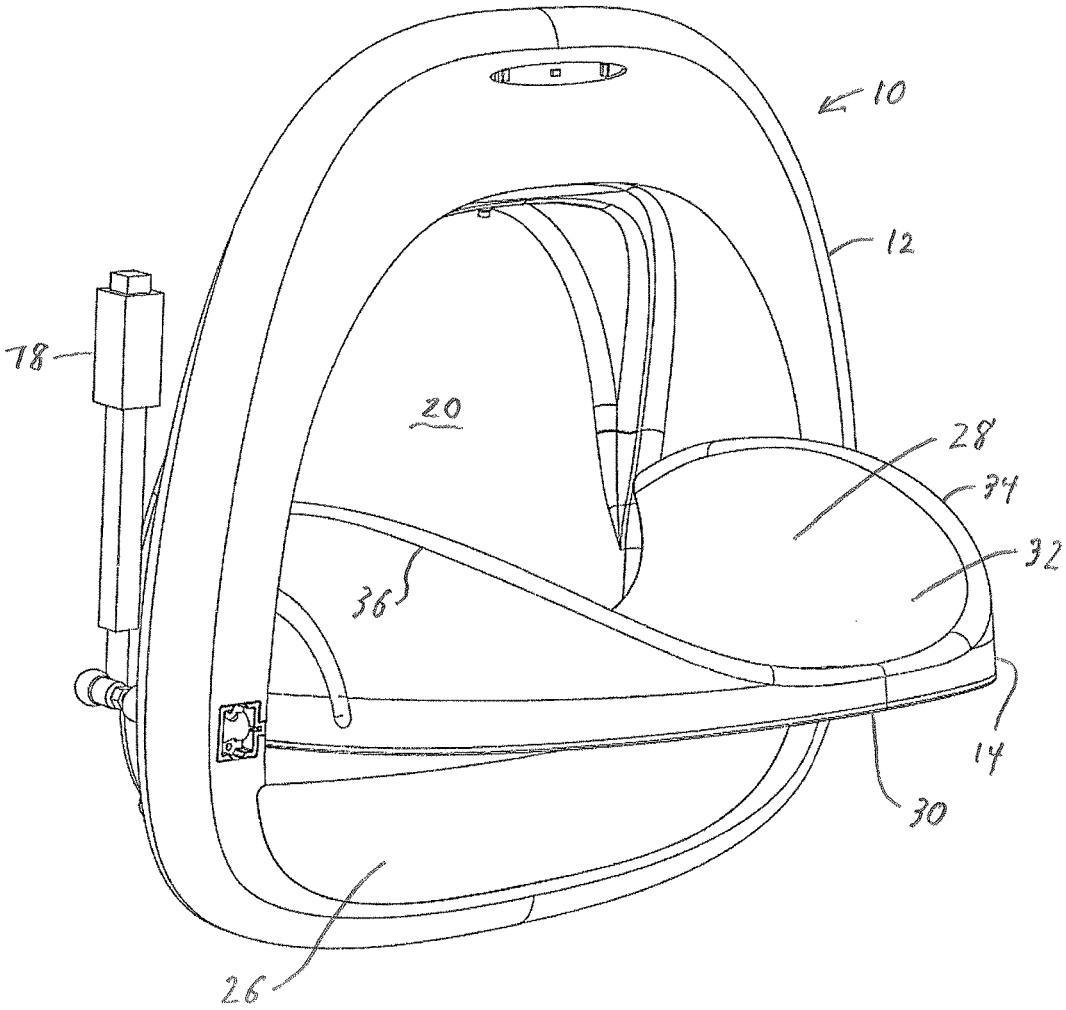
FIG. 1 is a perspective view from the left of the front of a folding urinal in accordance with one embodiment of the present invention, showing the urinal in "in use" mode.

Referring now to the drawings, there is shown a folding urinal 10 in accordance with one embodiment of the invention. The urinal 10 includes a main body 12 and a tray 14 which is pivotally attached to the main body 12. The urinal 10 is adapted to be mounted on or partially in a wall (not shown), which is preferably an internal wall of a building such as a dwelling, in a bathroom or toilet. The urinal 10 may preferably be fully or partially recessed into a cavity (not shown) of the wall such that it is substantially concealed. If the wall cavity variant is used, the depth of the cavity is preferably in the order of 70 mm to 75 mm. The attachment of the folding urinal 10 to a wall is such that it may easily be removed from the wall for servicing.

Main body 12 includes a base 16 (FIG. 7), in which is located an outlet 18 for liquid(s) introduced into the urinal 10 by a user and/or by flushing, a rear wall 20, and side walls 22, 24. There is also a front plate 26, which, with the base 16 and the lower pads of rear wall 20 and side walls 22, 24, defines an open chamber 28 into which the aforementioned liquid(s) may flow directly and/or from tray 14.

Tray 14 has a flat base 30 and a curved upper surface 32 which has a generally U-shaped cross-section, the shape being formed by two side walls 34, 36 curving from a mid-point of surface 32, the walls 34, 36 also rising from the front of tray 14 to the rear thereof. Tray 14 is pivotally attached to main body 12 by hinges 38, 40, for limited movement between the "standby" position of FIG. 2 and the "in use" position of FIG. 1. The hinges 38, 40 may take the form described in the following paragraph, in conjunction with FIG. 7 of the drawings.

Figure 7:
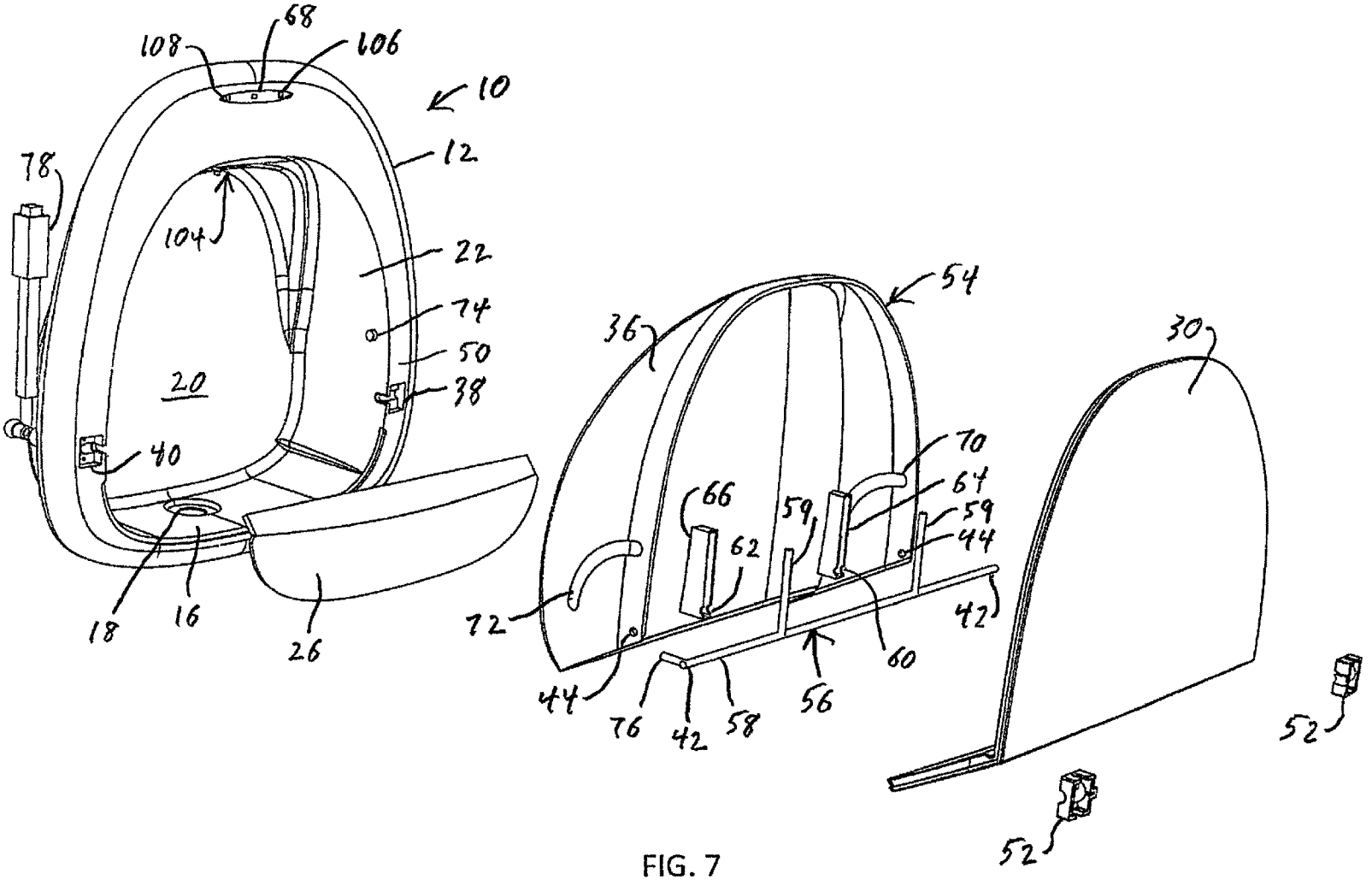
FIG. 7 is an exploded view of the folding urinal of FIGS. 1 and 2.

The tray 14 may be constituted as shown in FIG. 7, with base 30 formed separately to the main portion 54 of tray 14. In this variation, axles 42 may be part of an elongated H-shaped member 56, which is formed by main portion 58, the ends of which form axles 42, which in the assembled tray 14, protrude through apertures 44 in main body 54, and one or more elongated protrusions or prongs 59 that extend outwardly from main portion 58. The member 56, which is preferably formed from stainless steel rods welded together, is adapted to be located in recesses 60, 62 on ribs 64, 66 of the underside of body portion 54. Base 30 is then secured to main body 54, preferably by "sandwiching" member 56 between main tray body 54 and base 30. Preferably, the body 54 and base 30 are formed of plastics material, and the body 54 and base 30 are heat welded together in the "sandwiching" process.

Preferably, the body 54 and base 30 are formed of plastics material, and the body 54 and base 30 are heat welded together in the "sandwiching" process.

Figure 2:
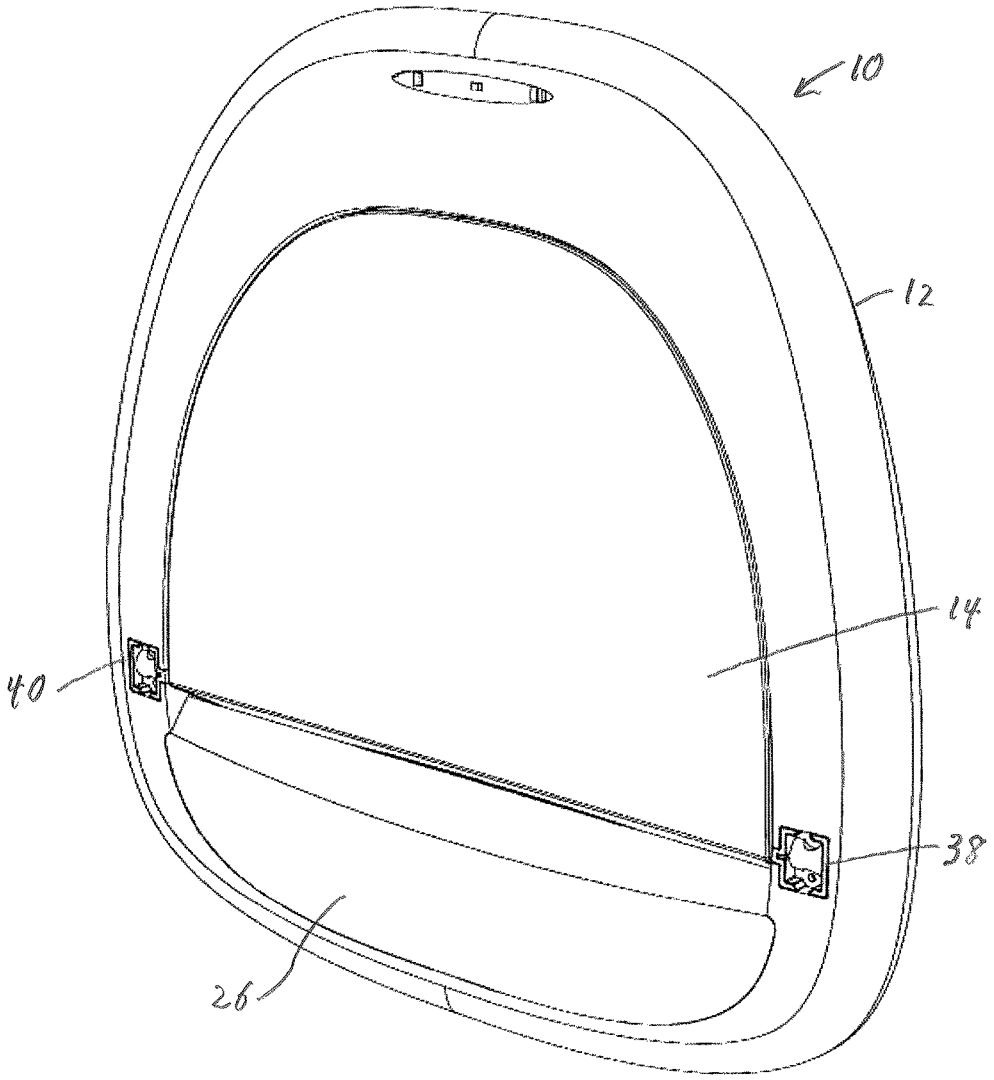
FIG. 2 is a perspective view from the left of the front of the folding urinal of FIG. 1, showing the urinal in "standby" mode.
Figure 3:
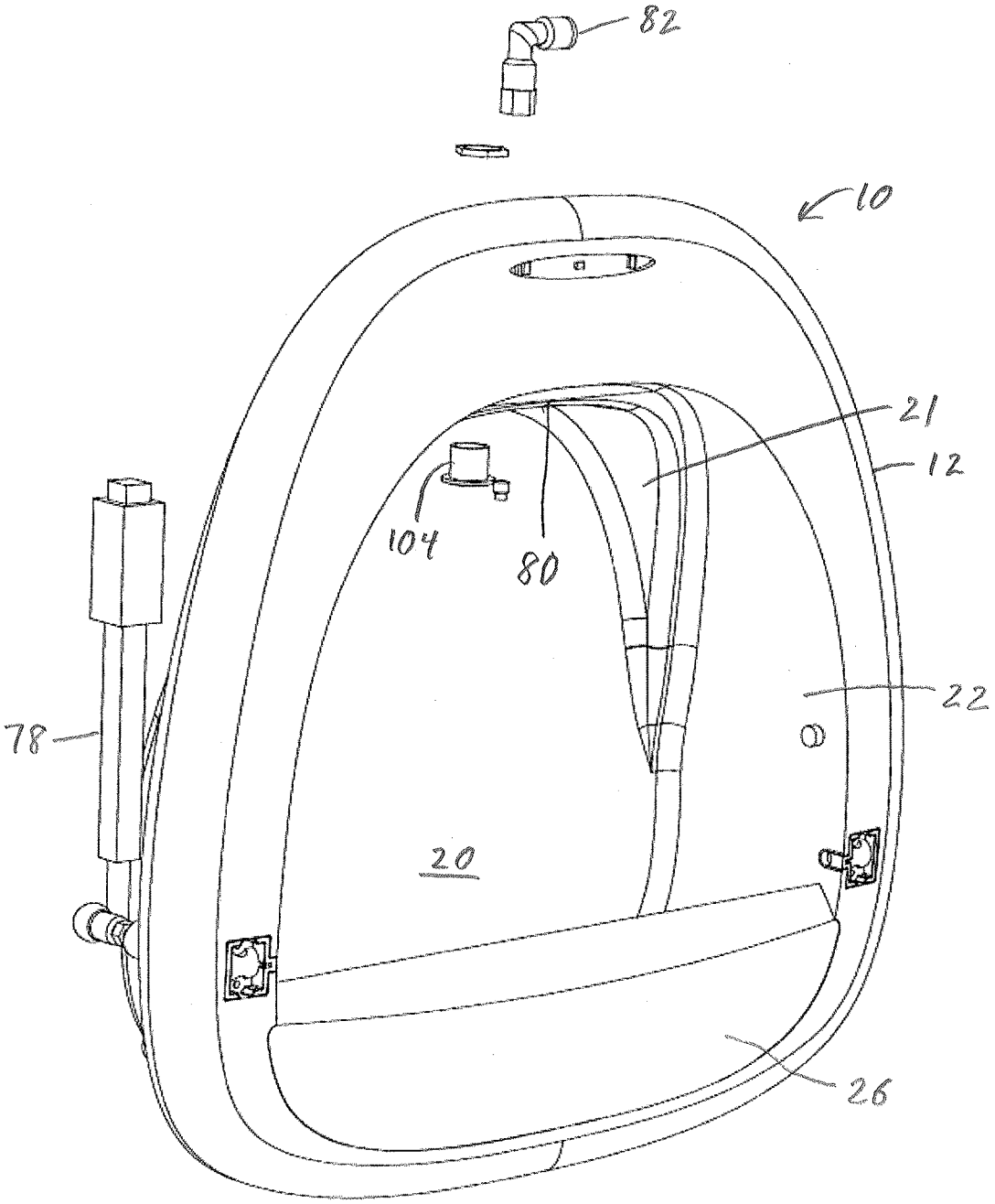
FIG. 3 is a partially exploded view from the front of the main body of the urinal of FIGS. 1 and 2.
Figure 4:
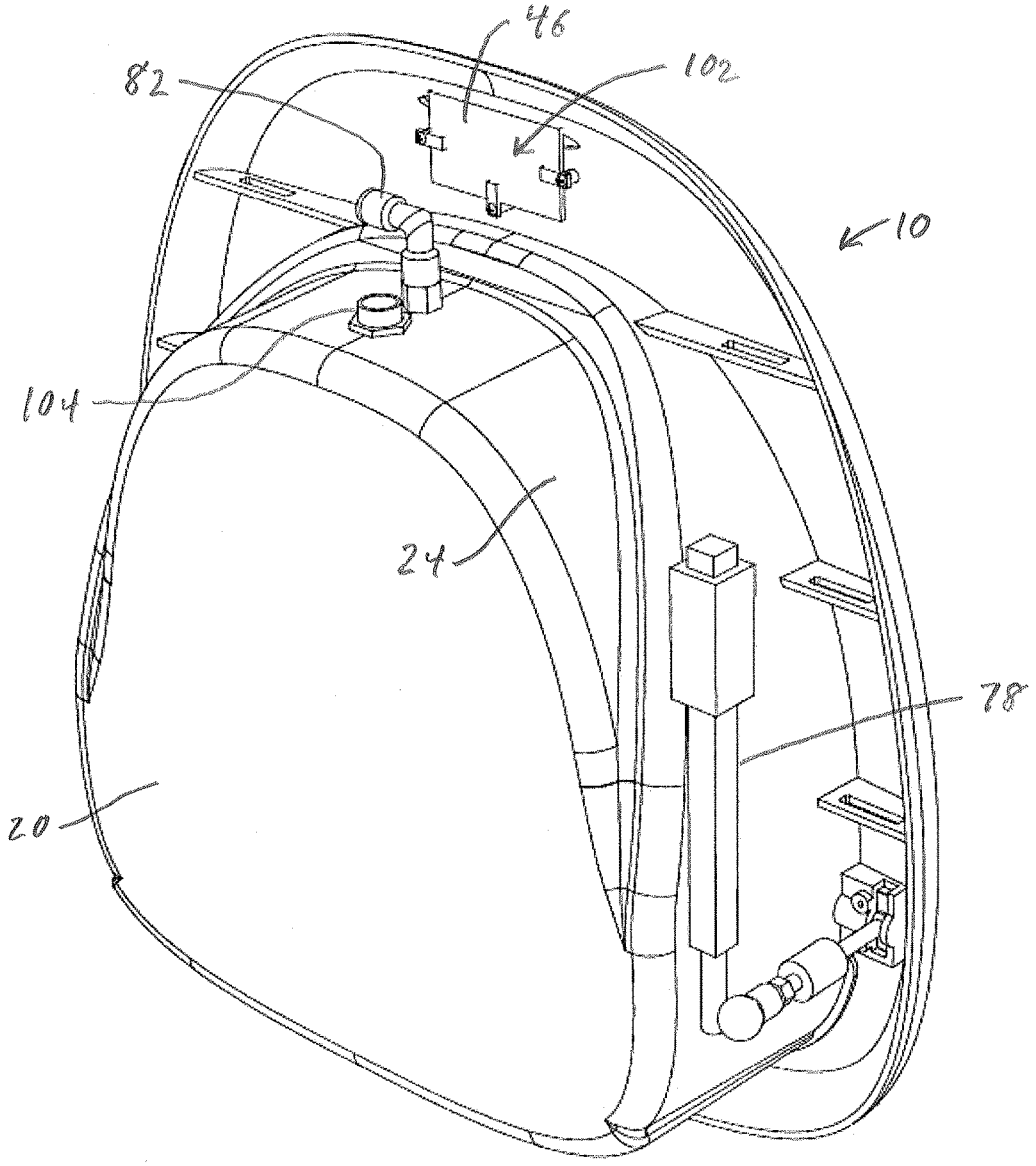
FIG. 4 is a perspective view from the rear of the main body of FIG. 3.
Figure 5:
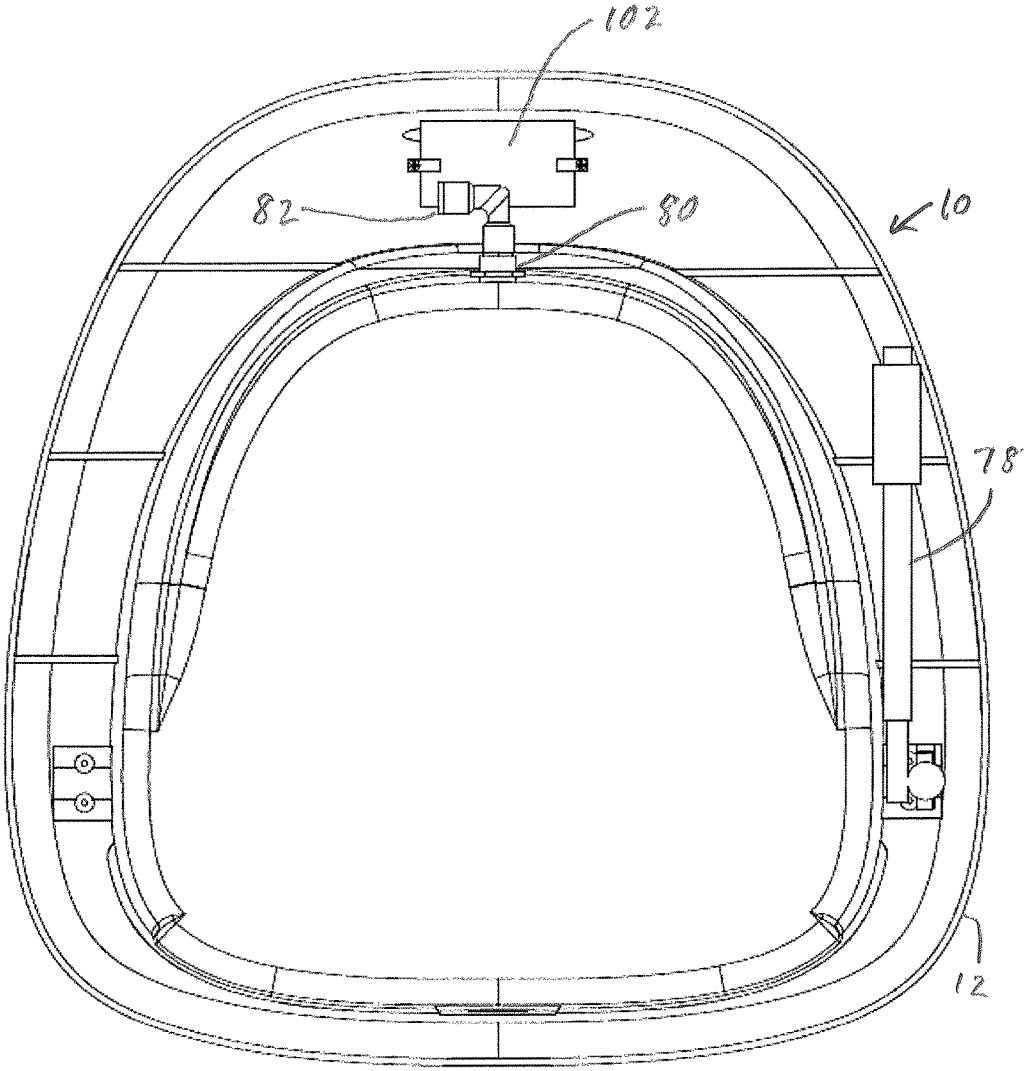
FIG. 5 is a rear elevation of the main body of FIGS. 3 and 4.
Figure 6:
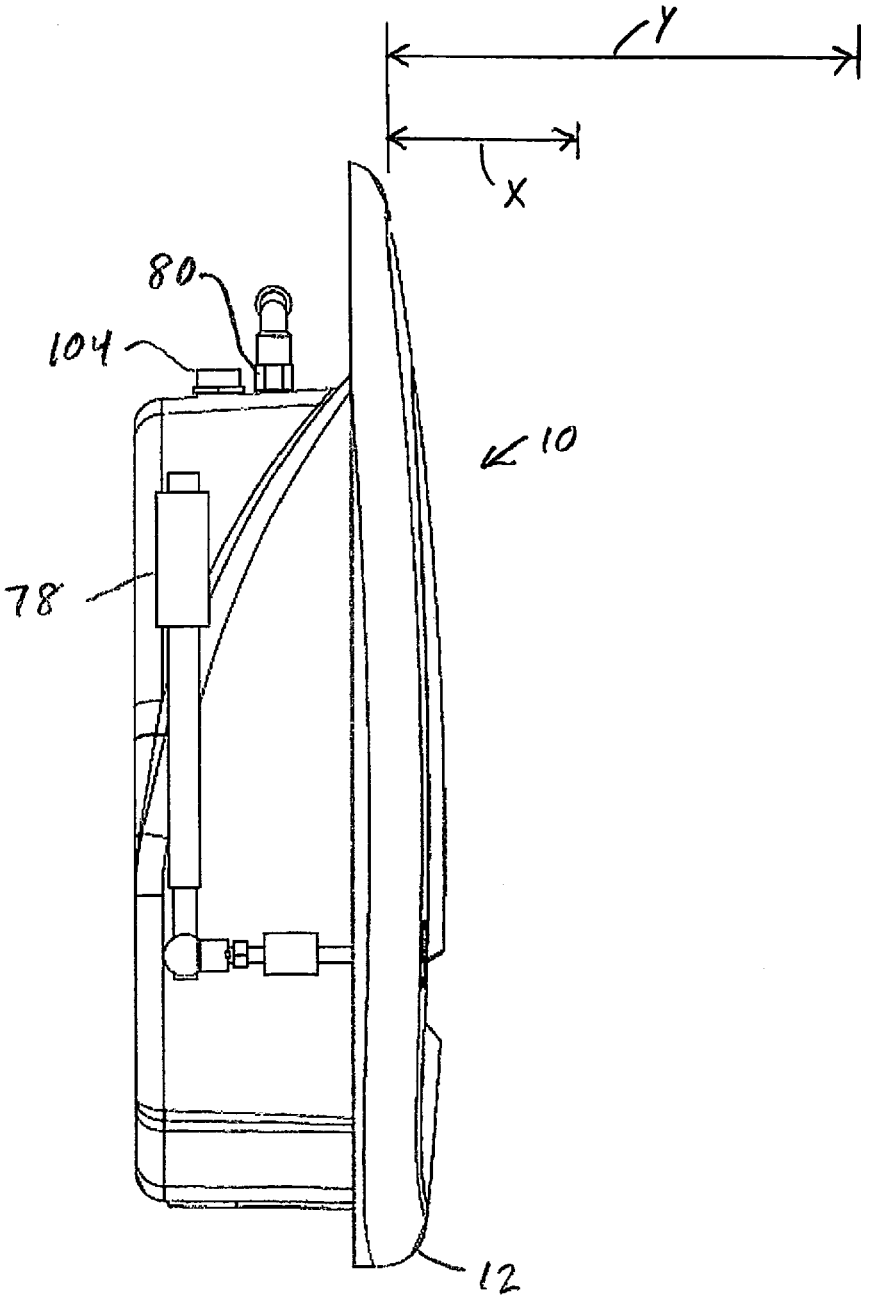
FIG. 6 is a side elevation of the right side of the main body of FIGS. 3, 4 and 5.

As may also be seen in FIGS. 1 and 7, the outside sides of walls 34, 36 are provided with arcuate slots 70, 72, which are adapted to engage protrusions (only one of which is shown as 74 in those figures) on the interior surface of walls 22, 24 of main body 12. The protrusions 74 may be made of rubber. The co-operation between the slots 70, 72 and the protrusions 74 guide and limit the pivoting of tray 14 relative to body 12.

Figure 8:
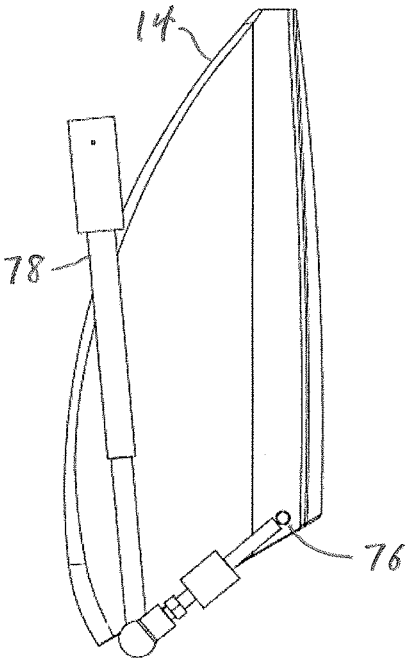
FIG. 8 is a side elevation of the tray and actuator of the folding urinal of FIGS. 1 and 2, showing the tray in its "standby" position.
Figure 9:
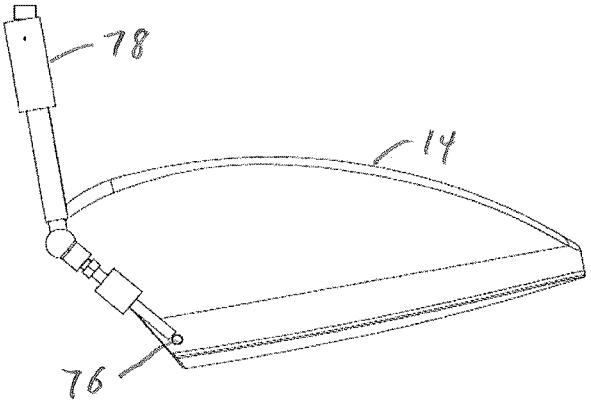
FIG. 9 is a side elevation of the tray and actuator of the folding urinal of FIGS. 1 and 2, showing the tray in its "in use" position.
Figure 10:
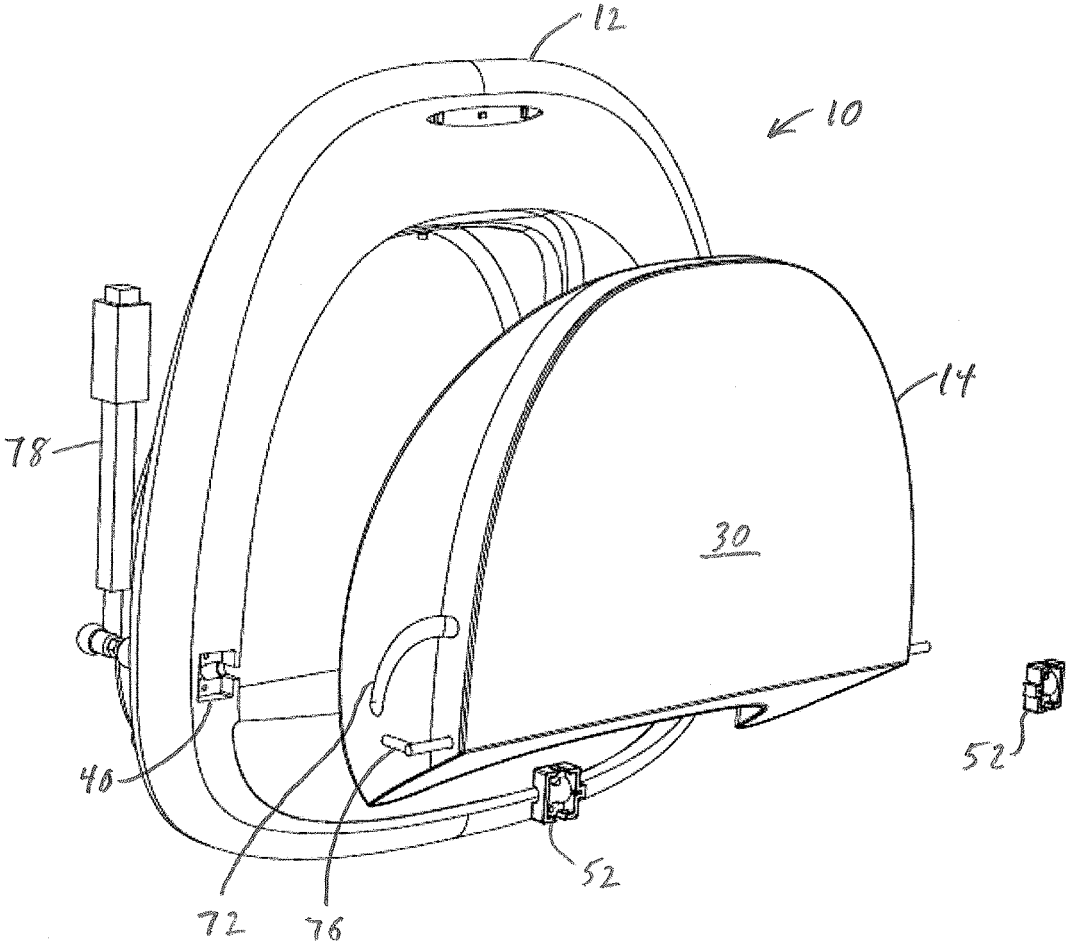
FIG. 10 is a perspective view from the left of the front of a folding urinal of FIGS. 1 and 2, showing the main body and tray separated.

Member 56 also has a connecting element 76, which is located near one end of portion 58 and extends generally at right angles to axle 42 at one end of portion 58. Connecting element 76 is intended to be connected to an actuator 78 (FIGS. 1, 3, 4, 5, 6 and 7), preferably an electric actuator, which is adapted to cause tray to move between "standby" and "in use" positions. FIG. 8 shows the "standby" position, and FIG. 9 shows the "in use" or "ready for use" position.

Folding urinal 10 has a flushing mechanism in the form of a nozzle or the like 80, which is located (FIGS. 4, 5 and 6) on main body 12 above the chamber 28. The nozzle 80 is connected to an adapter or connector 82 to a supply of flushing liquid such as water. The flow of liquid to spray nozzle 80 is controlled by a valve (not shown) which is preferably a solenoid operated valve operated as part of the automated system of folding urinal 10. The lowered design moulded shape area 21 prevents water coming from spray nozzle 80 from escaping out of the sides 34, 36 of tray 14 when it is in the closed position. As will be described later in this description, the valve is closed when the urinal is in opened (for a predetermined period of time) and closed during the sequence of the system controlling the operation of folding urinal 10.

The outlet 18 in base 16, receives urine is adapted to discharge urine received in chamber 28 of the urinal 10 into a sewage or equivalent system (not shown) for, eventually, treatment. Outlet 18 may be plumbed into such a system in a conventional manner known to someone skilled in the art.

Figure 13:
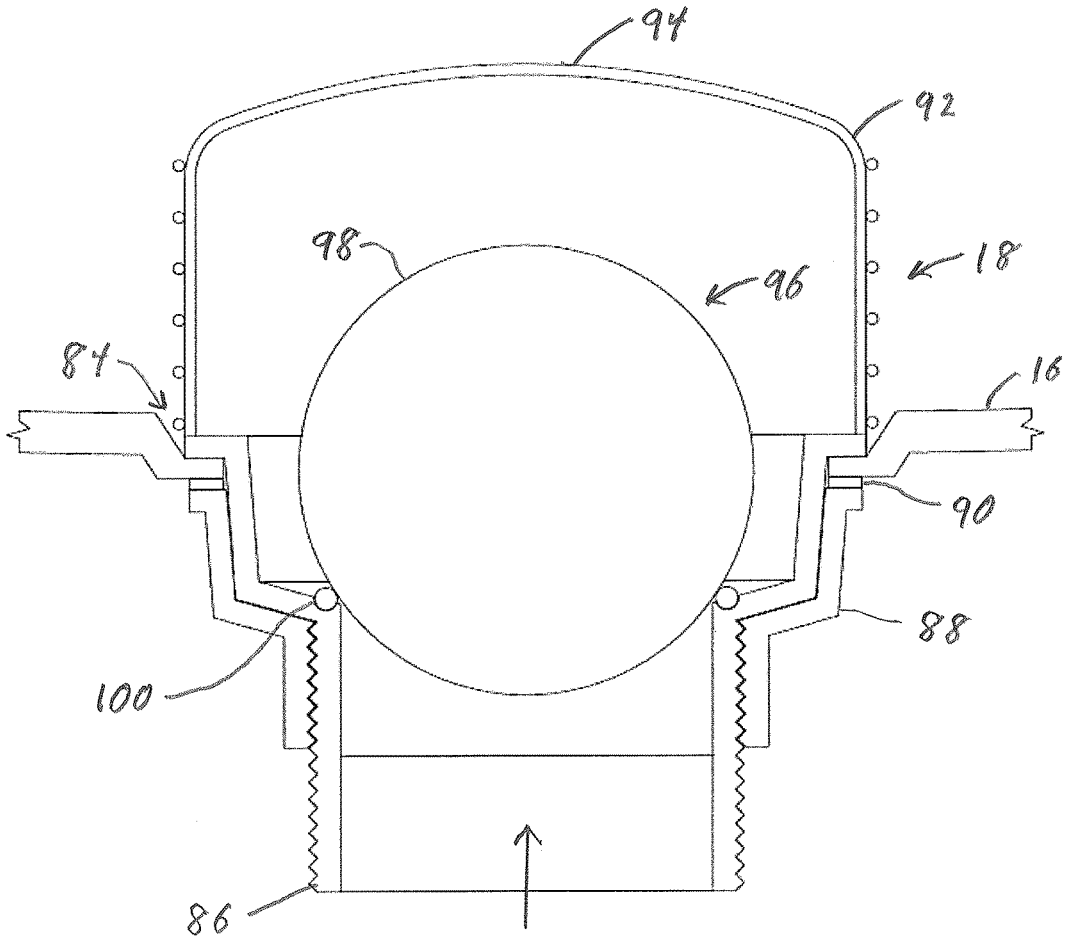
FIG. 13 is a section through one form of an outlet arrangement for the main body of the folding urinal of FIGS. 1 and 2.

One form of outlet 18 is shown in FIG. 13. In a (preferably circular) aperture 84 in base 16 of main body 12 of folding urinal 10 is located an outlet pipe 86 adapted to be secured to base 16 by being connected to outlet member 88, preferably by screwing together the two elements 86, 88. A gasket 90 preferably provides a seal between elements 86, 88 and base 16. A cage, which may be removably secured to outlet 86 or which may be integral therewith, has a side 92 which permit liquid to pass therethrough but which prevent the passage of larger objects. This side (and the top 94 may also allow passage of liquids but not solids) may take any suitable form, such as perforations or a mesh of some kind.

Within cage 92 is a mechanism 96 for preventing odours from entering folding urinal 10, and by extension the room in which the folding urinal 10 is located, from the pipes leading to the sewage system, from the direction of the arrow in FIG. 13. A generally spherical ball 98, similar to a table tennis ball in weight, is adapted to seat on a seal 100 located on a restricted diameter portion of outlet pipe 86. In this position, the combination of the ball 98 and seal 100, which may preferably be in the form of an O-ring, will prevent the aforementioned odours from passing through the pipe 86 into chamber 28, main body 12 and folding urinal 10. However, when liquid enters chamber 28 and passes through cage 92, it will lift ball 98, allowing the liquid to pass between the ball 98 and the seal 100 into pipe 86.

A housing 102 (FIGS. 4 and 5) is located on the rear face of main body 12 of urinal 10, near nozzle 82. The housing 102, which has a cover plate 46 attached by clips or screws, contains a printed circuit board which operates the various elements of the operating system for the folding urinal 10, which elements may include a light 104, which located at the top of main body 12 and is adapted to illuminate the interior of the folding urinal 10, a short range sensor 106 and a long range sensor 108, which are visible, and operate, at the front upper part of main body 12 (FIGS. 1, 2, 3 and 7). The operation of the light 104 which preferably produces a soft light, and the operation of the sensors, will be described later in this specification. The actuator 78, the flushing water valve, and any other aspect of the system operating folding urinal 10 is connected in the printed circuit board (PCB) in housing 102 and which contains the sensors 106, 108 housed therein, and which may also include a microprocessor or the like for optimal operation of the circuit and the folding urinal 10 system.

Figure 11:
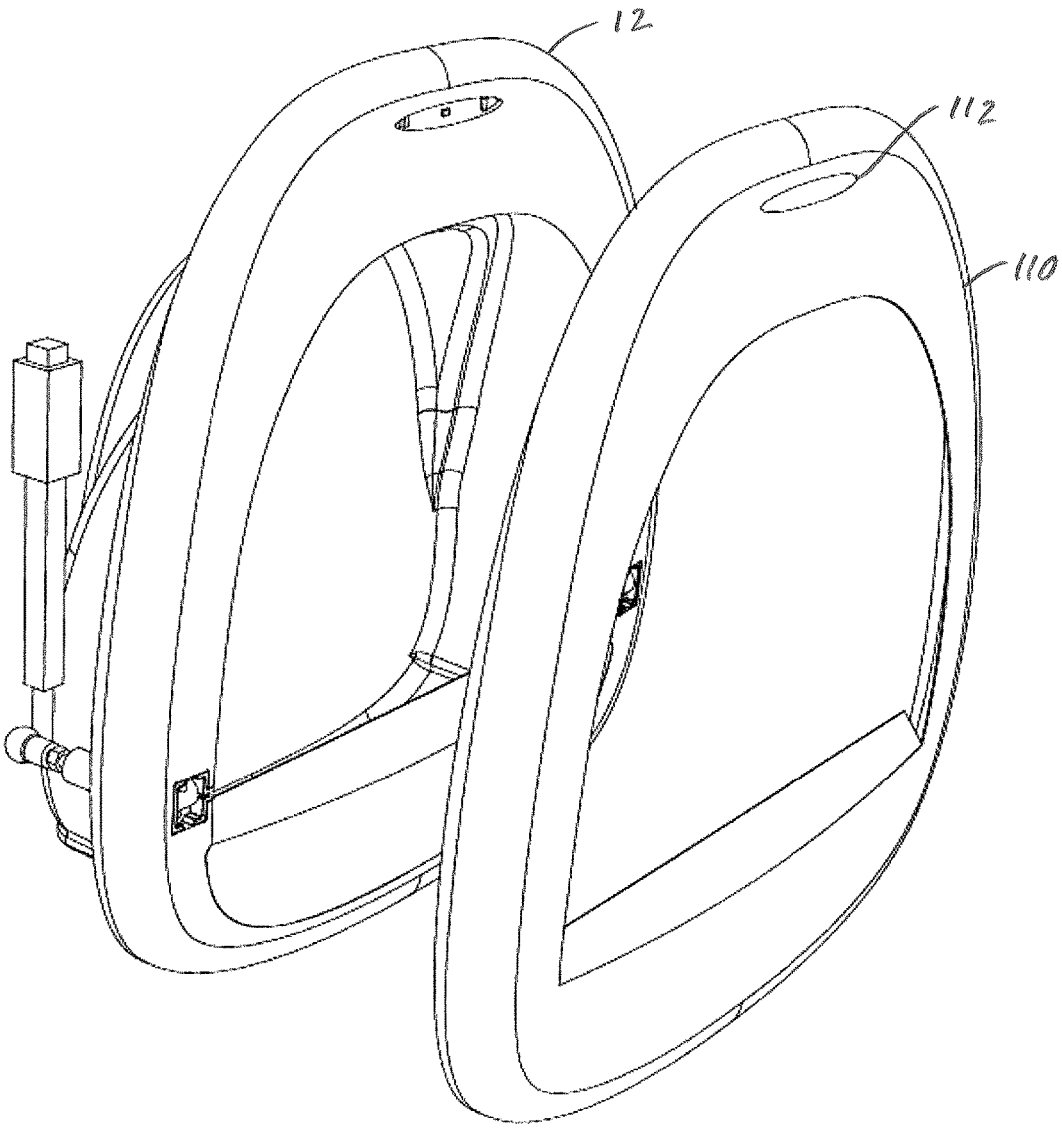
FIG. 11 is a perspective view from the left of the front of a folding urinal of FIGS. 1 and 2, showing a cover for the main body separated therefrom.
Figure 12:
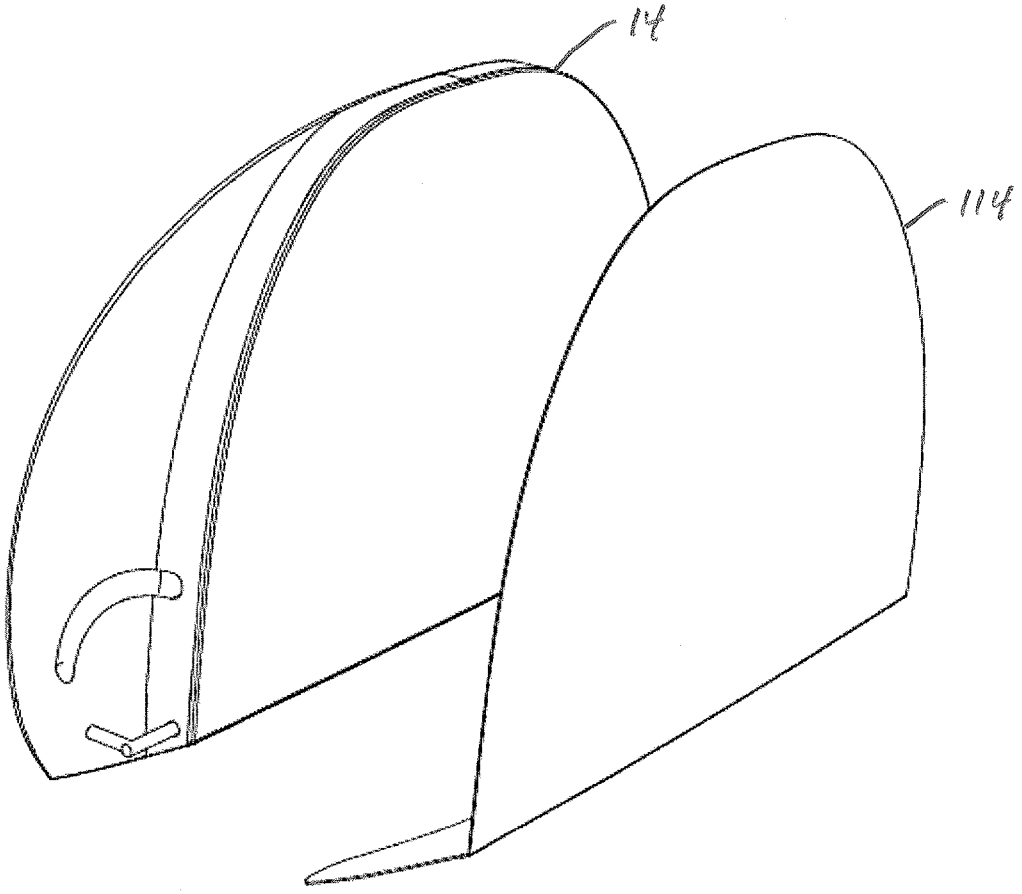
FIG. 12 is a perspective view from the left of the front of a folding urinal of FIGS. 1 and 2, showing a cover for the tray, separated therefrom.

FIG. 11 shows main body 12 and a cover 110 which desirably is secured to body 12 to provide a pleasing appearance to the folding urinal 10, and to cover any elements of the body 12 which serve a practical purpose and which are not very aesthetic. The cover 110 has an aperture 112 which, when the cover is attached to body 12, is in register with the short range sensor 106 and long range sensor 108, in order to allow them to operate. FIG. 12 shows tray 14 and a cover 114 for tray 14 to again provide a pleasing appearance for urinal 10. Preferably, the main body 12 and tray 14 are formed from plastics material, and the covers 110, 114 may be formed from high-quality plastics material with an attractive glossy finish, or from chrome, or stainless steel with a finish of brushed, polished, patterns and the like. Desirably, if the covers 110, 114 are formed from plastics material, they are heat-welded to body 12 and tray 14 respectively.

The folding urinal 10 may be programmed to operate in the following manner, which describes the sequence of operation of the folding urinal 10 according to a preferred embodiment of the present invention. In the context of this explanation, the term "actuator overload" is defined as a situation in which it is detected that the actuator is unable to fully open the tray 14 to the "ready for use" or "in use" position or fully close the tray 14 to the "standby" position. This may be due to some obstruction preventing the tray 14 from being fully opened or fully closed.

In the standby mode, the tray 14 is in an "out of use" position, closed and flush to main body 12. If someone approaches within the predetermined range "X" (preferably with a hand or other part of the persons' body) of short-range sensor 106, the sensor will detect the presence of that person, and as a result will switch on the light 104, and open the tray 14 to the "in use" position. The urinal 10 is then able to be used. It is to be understood that this means that the folding urinal 10 may be used in a dark room, and that there may be no need to switch on the room's light in order to use the urinal. Alternatively, the system may be programmed so that the light is not switched on if the room light is on. This would require light detection means coupled into the printed circuit board of the operating system of folding urinal 10.

When a male person wishes to use the urinal 10, and has approached the urinal 10 within the predetermined distance of long range sensor 108, the urinal 10 will be in the "ready for use" position of FIG. 1. The male person would then urinate into the open chamber 28. Under gravity, the urine would run down the chamber 28 to the base 16 of main body portion 12, and out through outlet 18 to a sewage system or the like.

The long range sensor 108 also has a predetermined detection range, preferably a distance "Y" of up to approximately 500 mm) However, should an actuator overload be detected by the actuator overload detector, the tray 14 will be closed and the light 104 caused to flash three times. This returns the urinal 10 to the standby mode. If no overload is detected, the system will ignore all signals from the short range sensor 106 and the long range sensor 108 for a predetermined period of time, for example two minutes. At the end of that time period, the long range sensor 108 is interrogated, and if no motion is detected, the tray 14 is closed. If motion is detected by the long range sensor 108, the system delays for another predetermined period of time, for example one minute, and the long range sensor 108 is again interrogated. If motion is again detected, the system will again delay for the predetermined time, and this will repeat until an interrogation of the long range sensor 108 reveals no motion within the range of the sensor.

When interrogation of the long range sensor 108 shows no motion, the tray 14 will be closed. If actuator overload is detected, the tray 14 will be immediately opened again, and the light 104 caused to flash three times. If no actuator overload is detected, the light 104 will be switched off after a third predetermined period of time, for example two seconds. The system then waits for a further predetermined period of time, for example three seconds, and then the solenoid-operated valve controlling the flow of flushing water through the spray nozzle 80 is activated for another predetermined period of time, for example ten minutes. The urinal 10 is then in standby mode again. It should be noted that the sensors 106, 108 in this variant are effectively motion-detecting sensors.

Figure 14:
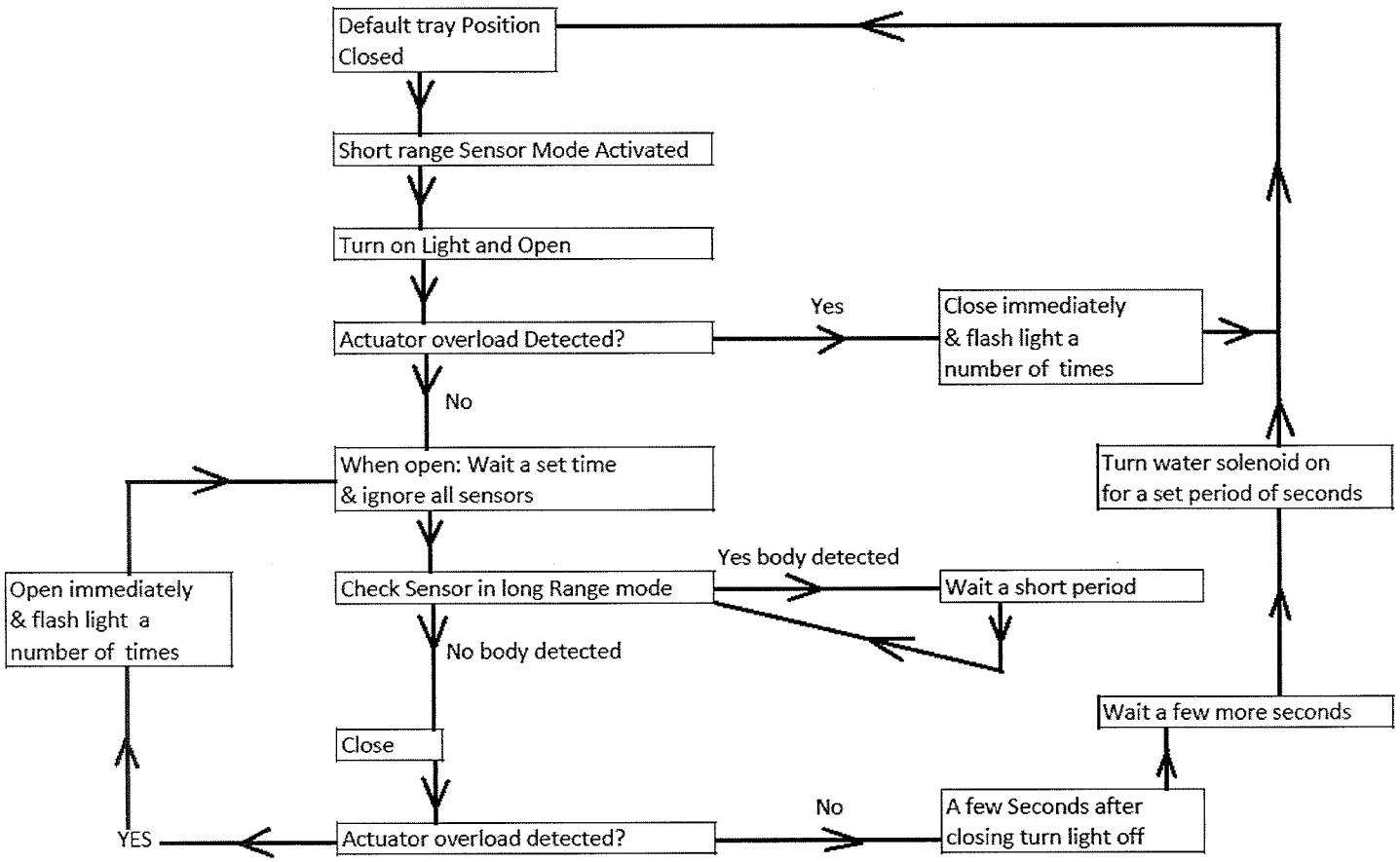
FIG. 14 is a flow chart showing the automated operation of the folding urinal of FIGS. 1 to 12.

An alternative method of operation of the folding urinal 10 is shown in FIG. 7 and the flow chart of FIG. 14. This method uses an infra-red sensor which in FIG. 7 is designated 68, 106 and 108. Such an infra-red sensor, which is of a conventional design, detects the presence of something or someone in front of the folding urinal 10, whether something or someone is moving or not, within a predetermined distance, and as a result the printed circuit board commences the change from the "standby" mode of the folding urinal 10 to the "ready for use" mode. If two sensor elements 106, 108 are used, they may be infra-red light emitters, and the infra-red detector is shown as 68. These emitters 106 and 108, and receiver 68, are connected directly to the PCB in housing 102, with preferably a seal such as an O-ring between the housing 102 and a tinted infra-red-friendly window (not shown), preferably of plastics material, surrounding the connection of each element 106, 108 and 68 to prevent infra-red light reflecting between them, thereby eliminating interference. This window would desirably be able to allow the passage of infra-red light, while showing a tinted appearance to a user of the folding urinal 10.

The infra-red sensor is programmable to detect the presence or absence of something or someone over both the short range and long range distances described earlier in this specification. As part of its operation, the printed circuit board is able to change between short range and long range detection as part of the sequence of operation shown in the flow chart of FIG. 14.

Although the aforementioned embodiment of the present invention has been described with an automated operation, it would be entirely possible for the folding urinal 10 to be operated manually or partially manually and partially automatically. The tray 14 may be able to be opened and close manually by pressing a pressing button which is a part of a control circuit, but then the urinal 10 may operate as described hereinbefore. Alternatively, the urinal 10 may be entirely manually operated, with manual operation, through buttons, of the tray 14 opening and closing, the switching on and off of the light 104, and the operation of the flushing spray nozzle 80.

Preferably, the entire front face of the folding urinal 10 has a chrome plush finish, gloss plastics material, a stainless steel finish, or the like.

It may be seen that the folding urinal of the present invention has many advantages. It is compact, taking up little space in a bathroom or toilet. It may be provided with a quiet flush so as not to wake anyone else in the dwelling, unit or the like. There is no need to turn on the bathroom light and thus wake up other persons. The urinal 10 is water-efficient, using only a small spray nozzles 80 for a few seconds. Females would be happy that the toilet seat will never be urinated on, nor the toilet seat left up.

In addition, water consumption for flushing is only a fraction of that used when a conventional pedestal toilet of the type installed in dwellings is used for male urination. The folding urinal 10 is more hygienic, in that there is much less chance of urine finding its way onto the toilet or bathroom floor from errant urine delivery, because the tray 14 is below and close to the scrotum. Also, because of the automated system operating the folding urinal 10, male persons will be less likely to forget to fasten their fly, and it is further more hygienic because it is not necessary to touch any button to operate the urinal 10 or the flushing mechanism.

The urinal 10 of this invention would be suitable for domestic bathrooms, bathrooms in hotel/motel rooms, cabins, aircraft, ships, boats and any other situation where it is desired to have a urinal and save space.

As installed, the main body 12 and the urinal 10 will desirably have a generally vertical orientation.

The invention claimed is:

1. A folding urinal including a main body and a tray connected to said main body by a hinge member, said hinge member including a plurality of axles that protrude from respective sides of the tray for pivotally attaching said tray to said main body, said hinge member including a connecting element coupled to said tray, said tray being adapted to move between a first position in which said tray is adjacent to said main body and said tray is in standby mode and a second position in which said tray is at an angle to said main body and said tray is in a ready for use mode and is adapted to receive urine from a user of said folding urinal, an actuating mechanism is mounted on said main body, said connecting element of said hinge member being connected to said actuating mechanism such that said actuating mechanism is connected to said tray and such that said actuating mechanism is adapted to move said tray between said first position and said second position of said tray, wherein said hinge member includes an elongate main portion having a first end and a second end, an axle of said plurality of axles being located at each end of said main portion, said connecting element extending outwardly from said main portion, and one or more elongated protrusions that extend outwardly from said main portion of said hinge member, said elongated protrusions being located in respective recesses formed in said tray thereby locking said tray to said hinge member and enabling said connecting element to control rotational movement of said tray.

2. A folding urinal according to claim 1, wherein said tray comprises a base and a body portion that has two side walls, the base and the body portion being formed as two separate parts that are secured together forming an internal cavity to make said tray.

3. A folding urinal according to claim 1 having a front face and/or a decorative front cover that surrounds the outer front part of the urinal.

4. A folding urinal according to claim 1, adapted to be mounted on or partially in a wall such that it may easily be removed from the wall for servicing.

5. A folding urinal according to claim 1, comprising a light adapted to illuminate the interior of said folding urinal.

6. A folding urinal according to claim 1, comprising a flushing mechanism adapted to flush said folding urinal after use, when said tray is in said first position.

7. A folding urinal according to claim 1, comprising a light adapted to illuminate the interior of said folding urinal, a flushing mechanism adapted to flush said folding urinal after use, when said tray is in said first position, and a programmable microprocessor-controlled controller adapted to control operation of said actuating mechanism, sensor, light and flushing mechanism.

8. A folding urinal according to claim 1, which has a lowered designed moulded shape area to prevent water that comes from a spray nozzle from escaping out of sides of said tray when said tray is in the first position.

9. A folding urinal according to claim 1, with a main body cover and tray cover made of plastics, chrome or stainless steel.

10. A folding urinal according to claim 1, adapted to be fully or partially recessed into a wall cavity having a depth of at least 7 cm.

11. A folding urinal according to claim 1, wherein the tray comprises a base and a body portion, wherein said one or more elongated protrusions are sandwiched between the base and the body portion of the tray.

12. A folding urinal according to claim 1, including a sensor adapted to detect the presence of a person within a short range detection distance from said folding urinal and adapted to detect the presence of a person within a long range detection distance from said folding urinal, said short range detection distance of said sensor being shorter than said long range detection distance of said sensor, said short range detection distance of said sensor being at least partially included in said long range detection distance of said sensor, wherein a first signal from said sensor resulting from the detection of a person within the short range detection distance causes said actuating mechanism to move said tray from said first position to said second position, and a second signal from said sensor resulting from the detection of the absence of a person within the long range detection distance causes said actuating mechanism to move said tray from said second position to said first position.

13. A folding urinal according to claim 12, wherein said sensor comprises a short range sensor adapted to detect the presence of a person within said short range detection distance from said folding urinal, and a long range sensor adapted to detect the presence of a person within said long range detection distance from said folding urinal, the short range sensor adapted to produce said first signal for moving said tray from said first position to said second position, and said long range sensor adapted to produce said second signal for moving said tray from said second position to said first position.

14. A folding urinal according to claim 12, wherein said sensor comprises a motion sensor.

15. A folding urinal according to claim 12, wherein said sensor comprises an infra-red sensor.

16. A folding urinal according to claim 12, wherein said long range detection distance of said sensor is up to 50 cm.

* * * * *